United States Patent [19]

Underwood

[11] 4,228,897

[45] Oct. 21, 1980

[54] STACKING ELEMENT FOR RETAINING STACKED ARTICLES

[76] Inventor: J. Larry Underwood, 104 Dixie Dr., Woodstock, Ga. 30188

[21] Appl. No.: 44,077

[22] Filed: May 31, 1979

[51] Int. Cl.[3] ..... B65D 21/02

[52] U.S. Cl. ..... 206/504; 206/508; 206/821; 220/234; 220/236

[58] Field of Search ..... 206/504, 821, 508; 220/23.4, 23.6

[56] References Cited

U.S. PATENT DOCUMENTS

| | | | |
|---|---|---|---|
| 3,317,087 | 5/1967 | Landis | 206/821 |
| 3,422,564 | 1/1969 | Izumi | 206/821 |
| 3,815,281 | 6/1974 | Kanter | 206/504 |
| 4,003,491 | 1/1977 | Wells | 206/504 |

*Primary Examiner*—George E. Lowrance

*Attorney, Agent, or Firm*—Quaintance, Murphy & Richardson

[57] ABSTRACT

A stacking element is formed to engage two vertically stacked articles to hold the articles in position and is provided with projections on its external periphery to engage the projections on adjacent elements. These elements will maintain the articles in a stack against vertical and lateral displacement, so the stack will remain assembled during storage and transport.

7 Claims, 6 Drawing Figures

STACKING ELEMENT FOR RETAINING STACKED ARTICLES

GENERAL NATURE OF INVENTION

The stability of stacks of articles during storage and transport is assured by a simple, stacking element which is interposed between each two vertically adjacent articles. This element retains the articles against lateral shifting and also engages similar laterally adjacent elements to prevent shifting of the stacks, thus maintaining the stacks under all conditions.

In storage and transport of articles in stacks, especially in palletizing stacks for loading and unloading, the articles frequently shift so that the stacks collapse and the articles fall, resulting in delays and damage to the articles. The storage and movement of cans of paint is an example of this problem, the collapse of several tiers of stacked cans on a pallet often seriously damaging the cans and requiring substantial time to replace the cans for shipment.

To avoid this difficulty, it has been the partice to use sheet material, such as plywood, between the tiers and also as lateral spacers, thereby reducing the possibility of stacks falling over due to shifting of the cans. However, this use of sheet material is expensive, both for the sheets of plywood and for the handling of the sheets. Applicant's stacking elements are so inexpensive that they can be easily handled or discarded, and therefore do not involve problems for the shipper. They also are small and light, adding no significant weight and occupying little space. This element may be a molded plastic endless peripheral member to be seated on or fixed on one end of an article, such as a paint can, with a seat formed to receive the end of an adjacent, vertically stacked article, and formed with a peripheral series of lateral projections to engage similar projections on elements of laterally adjacent stacks. In this manner, the elements will hold the individual articles and the stacks from shifting and becoming disarranged. The stability of the stacks of articles makes the packaging of a group of stacked articles quite feasible, as, for example, with plastic foil applied to the stacked group, since the articles are retained against lateral displacement.

DRAWINGS

DETAILED DESCRIPTION

Figure 1:
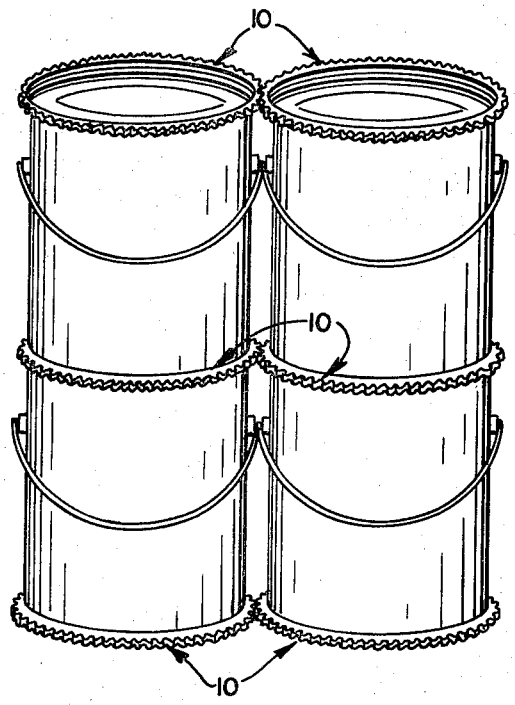
FIG. 1 shows stacked articles in phantom lines with the stacking elements of this invention between the articles of the stack.
Figure 2:
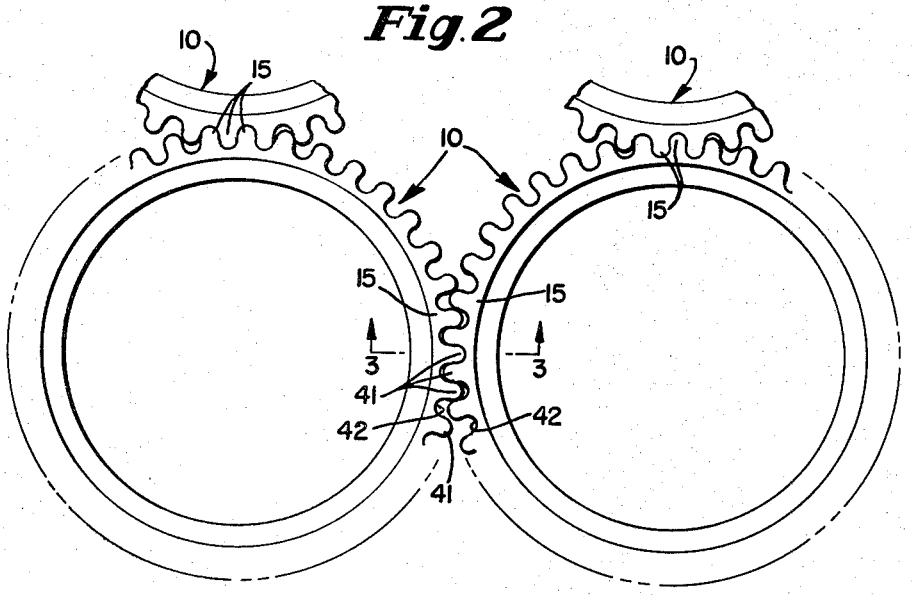
FIG. 2 is a fragmentary cross section of the stacking element, showing the rims of vertically adjacent articles engaging the stacking element.

The stacking elements 10 of this invention, as shown in FIG. 1, engage stacked articles A to position the articles and maintain them in the stack. Each element 10 is in the form of a peripheral frame having a closed configuration to conform to the ends of the articles. The stacking element 10 has lateral or horizontal tabs or web 11 on its inner periphery with vertical shoulders or ribs 12, 13 to form seats for the top and bottom ends of article A, as shown in cross section in FIG. 2. The tabs or web 11 with the shoulders or ribs 12, 13 form seats to be engaged by vertically stacked articles to prevent relative shifting of the articles in the stack.

Figure 5:
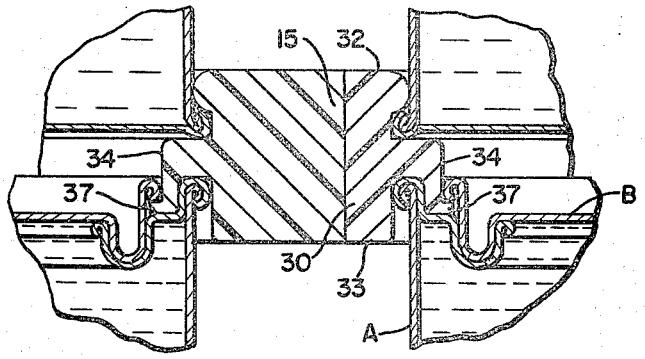
FIG. 5 is a fragmentary view of two adjacent stacking elements, showing interengaging projections on the elements.

A continuous series of lateral projections or "teeth" 15 is provided on the external periphery of the stacking element 10 (FIG. 5) to engage corresponding projections on an adjacent stacking element and prevent lateral shifting of adjacent articles. As will be seen in FIG. 1, the stacking elements interengage with the articles and with the other stacking elements to hold the articles in position in the stack.

Figure 3:
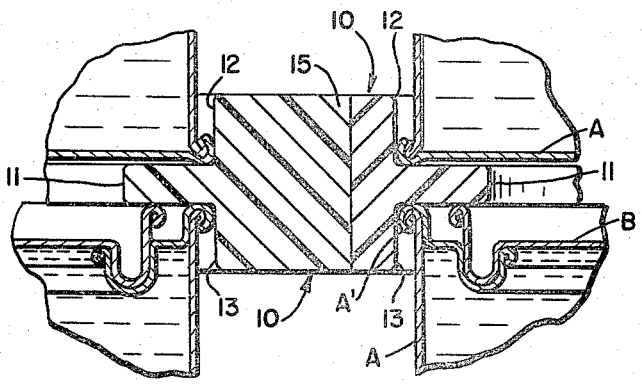
FIG. 3 is a fragmentary cross section corresponding to FIG. 2 of another form of stacking element.

A modified form of stacking element 20 shown in FIG. 3 is formed for attachment to the articles. The stacking element 20 with the lateral tap or web on its internal periphery and the vertical shoulders or ribs 22, 23 may be snapped over the beads on the ends of the articles. A lateral protrusion or boss 26 on the internal side of each shoulder or rib extends over the bead A' on the article, so that the stacking element 20 may be attached to the article by forcing the protrusion or boss 26 over the bead, which is received in a recess 27 on the periphery of the element 20. The resilience or flexibility of the material of the element 20 will allow the element to be distorted sufficiently to allow the protrusion 26 to be forced over the bead A' by starting at one side and engaging it with the bead and continuing around the bead of the article. This attachment of the stacking element to the articles provides further stability to the stack of articles.

Figure 4:
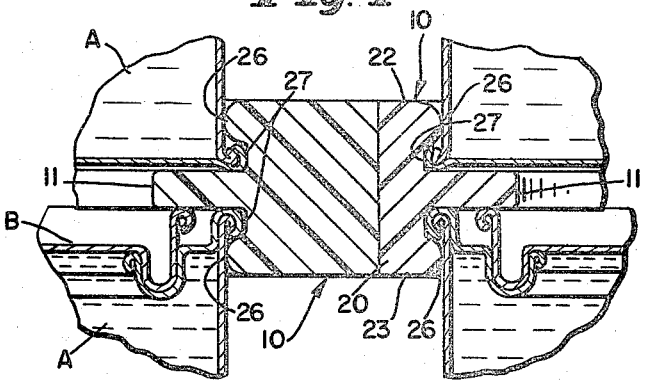
FIG. 4 is a fragmentary cross section corresponding to FIG. 2 of a third form of stacking element.

The stacking element may also be formed with a vertical rib or shoulder to fit within the end of an article, as shown in FIG. 4, which also shows the element attached to the article. In this form, the stacking element 30 with vertical shoulder 32, 33 is also provided with an inwardly spaced, vertical rib 34 which fits within the rim or bead A' of the article A. This vertical rib 34 also carries a laterally projecting lip 37 which underlies the edge of a lid B, when the lid is in position to close the container A. The stacking element is thereby connected securely to the container A and retained therewith. In this form, the upper article A may have a snap engagement with the stacking element, as in FIG. 3.

Figure 6:
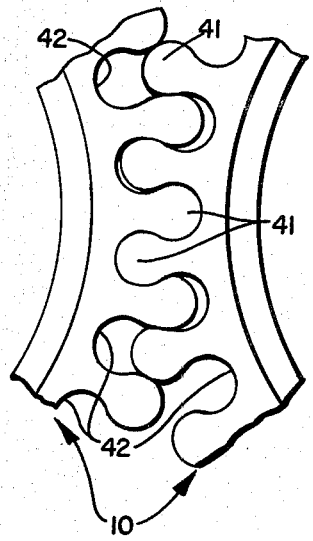
FIG. 6 is a fragmentary view of two adjacent elements, corresponding to FIG. 5, but showing a modified form of projection.

All forms of the stacking element are provided with external projections to engage corresponding projections on adjacent elements. These projections may be those shown in FIG. 5, or they may be of the form shown in FIG. 6. The projections 41 are wider at their outer ends than at their bases, with the spaces 42 between of complementary shape. As seen in FIG. 6, the projections of adjacent stacking elements interengage to prevent relative movement, the material of the element being flexible to allow interengagement of these projections.

The stacking elements of this invention will retain a number of articles in stacked relation, both vertically and horizontally. These elements may be easily molded of plastic material, which has sufficient flexibility to enable the elements to be engaged with the articles, as in FIG. 3, and may also interengage with other elements, as in the form shown in FIG. 6. The stacking element may also engage the external periphery of the article, as shown, or may also engage internally of a rim on the article, as in FIG. 4. Containers such as paint cans may be held by the stacking elements, and these elements may be attached to the cans, as in FIG. 4. While shown for paint cans in this one form, it will be recognized that the stacking elements may be designed to engage articles of circular, polygonal or other shapes.

I claim:

1. A molded plastic stacking element for assembling a plurality of similar articles vertically and laterally in a stack in a plurality of tiers with the articles in each tier laterally adjacent, said stacking element having a closed, peripheral configuration with a radial projection in a plane on its inner periphery to be interposed between two vertically adjacent articles and upper and lower rib formations on said closed configuration for laterally engaging rims on lower and upper ends of said vertically adjacent articles, said element having a series of spaced, solid lateral projections in said plane of said radial projection and extending laterally outwardly from its outer periphery a distance at least as great as the width of a projection and spaced by complementary spaces corresponding to said lateral projections in size and shape to receive and laterally engage similar projections on a laterally adjacent stacking element so that a plurality of said projections on adjacent elements will interengage in substantially any relative positions of said elements.

2. A molded plastic stacking element as claimed in claim 1, in which the projections on the outer periphery of said stacking element are of resilient material and are wider at their outer ends and are spaced by recesses complementary to said projections, so that projections on two laterally adjacent stacking elements resiliently interengage to restrict lateral movement of the elements and articles.

3. A molded plastic stacking element for maintaining stacked articles in proper relative position vertically and laterally, said element being formed to extend about the top and bottom perimeters of two vertically stacked articles and comprising a lateral formation extending in a plane between said top and bottom perimeters and vertical formations above and below said lateral formation to engage the outer sides of said perimeters, said element also comprising a peripheral endless series of solid lateral projections lying in said plane of said lateral formation and extending beyond said vertical formations and spaced by complementary spaces corresponding in size and shape to said projections, said projections extending laterally outwardly from the outer periphery of said elements a distance at least as great as the width of a projection, so that a plurality of said lateral projections on such stacking element may laterally interengage with similar projections on stacking elements on laterally adjacent articles to maintain the relative positions of said articles.

4. A molded plastic stacking element for maintaining stacked articles in proper relative position vertically and laterally, said element comprising a peripheral shoulder formation laterally engageable with a rim on the perimeter of the end of an article to position said element relative to said article and having a peripheral endless series of solid lateral projections extending radially beyond the perimeter of said articles and said shoulder, a distance at least as great as the width of a projection, said projections being spaced by complementary spaces corresponding in size and shape to said projections, said projections being resilient and pliable so that a plurality of projections may interengage with a plurality of projections of an adjacent element, and each of said projections having its outer end wider than its base so that such outer end may fit in the complementary space between similar projections of a series on a similar element, the resilience and pliability of said projections providing for such interengagement, said element being formed to engage the stacking element of a vertically adjacent stacked article to maintain said vertically stacked articles in proper position.

5. An assembly of similar articles for packaging or transport including means to maintain said articles in stacks of vertically aligned articles with said stacks in horizontal rows, said means comprising molded plastic stacking elements between each two vertically adjacent articles in said stacks, each stacking element being formed to extend between the bottom and top of the two vertically adjacent articles and having upwardly and downwardly extending vertical shoulder formations for engagement by rims on the perimeters of said articles to restrict movement of said articles relative to said element, each element having an endless series of solid radial projections extending laterally beyond its perimeter and the two vertically adjacent stacked articles and spaced by complementary spaces of a size and shape corresponding to the size and shape of said projections, the projections on each of said elements extending radially outwardly a distance at least as great as the width of a projection, so that a plurality of projections interengage with the projections on elements on adjacent stacks, and thereby prevent lateral relative movement of the articles in said assembly.

6. A container having a bead about its upper end and a lid engaging in the open end of the container and having a laterally, outwardly extending rib about the periphery of said lid, and a stacking element having a peripheral closed configuration with a lateral, inwardly extending formation to extend between vertically adjacent articles, said element having a vertical, upwardly extending shoulder formation to embrace the rim on the bottom end of an upper container, said element having a downwardly extending shoulder formation of less diameter than said upwardly extending shoulder formation and fitting within the bead about the upper end of said container, said shoulder formation having a laterally, inwardly extending lip structure underlying the outwardly extending rib on said lid to connect said stacking element on said container, said stacking element having a series of lateral projections on its external periphery for engagement with similar projections on adjacent elements.

7. In the combination of stacked articles and stacking element as claimed in claim 6, in which the upwardly extending formation has an inward protrusion structure formed to overlie a bead on the bottom of a vertically adjacent articles, so that said stacking element connects two vertically adjacent articles.

* * * * *